US005979029A

United States Patent [19]

McCartney et al.

[11] Patent Number: 5,979,029

[45] Date of Patent: Nov. 9, 1999

[54] METHOD AND APPARATUS FOR REMOVING CREASES FROM TUBULAR FABRIC

[75] Inventors: Phillip D. McCartney; Arne Nielsen, both of Oak Ridge; Donnie J. Thompson; Majid Moghaddassi, both of Greensboro, all of N.C.

[73] Assignee: GFD Fabrics, Inc., Greensboro, N.C.

[21] Appl. No.: 08/522,830

[22] Filed: Sep. 11, 1995

Related U.S. Application Data

[63] Continuation of application No. 08/108,339, Aug. 18, 1993, abandoned.

[51] Int. Cl.[6] ..... D06C 5/00

[52] U.S. Cl. ..... 26/80; 26/84; 26/81

[58] Field of Search ..... 26/80, 81, 83, 26/84, 85, 106, 51; 28/142, 167; 68/5 R, 5 A, 8, 5 B, 5 D; 8/149.3; 38/7, 9, 10, 49, 1 B; 226/1, 2

[56] References Cited

U.S. PATENT DOCUMENTS

| | | | |
|---|---|---|---|
| 2,228,001 | 1/1941 | Cohn et al. | 26/84 |
| 2,503,705 | 4/1950 | Blumenbaum et al. | 26/83 |
| 2,623,263 | 12/1952 | Dungler | 26/84 |
| 2,634,488 | 4/1953 | Cohn et al. | 26/84 |
| 3,868,215 | 2/1975 | Frezza | 8/149.3 |
| 3,875,624 | 4/1975 | Frezza | 26/56 |
| 3,955,251 | 5/1976 | Hogendyk | 26/80 |
| 3,973,305 | 8/1976 | Catallo | 26/85 |
| 3,978,557 | 9/1976 | Goodson | 26/84 |
| 4,146,946 | 4/1979 | Plaia et al. | 26/18.5 |
| 4,173,812 | 11/1979 | Cecere | 26/84 |
| 4,183,151 | 1/1980 | Frezza | 68/5 D |
| 4,192,045 | 3/1980 | Frezza | 26/84 |
| 4,236,392 | 12/1980 | Sando et al. | 68/5 E |
| 4,356,602 | 11/1982 | Heliot | 26/84 |
| 4,430,779 | 2/1984 | Rockman et al. | 26/18.5 |
| 4,875,260 | 10/1989 | Vecchia | 26/81 |
| 4,947,529 | 8/1990 | Werner et al. | 26/84 |
| 5,279,023 | 1/1994 | Strudel et al. | 26/85 |

*Primary Examiner*—Amy Vanatta

*Attorney, Agent, or Firm*—Kennedy Covington Lobdell & Hickman, LLP

[57] ABSTRACT

A method and apparatus removing creases from a tubular fabric including an assembly for moving the fabric through a fabric travel path, an assembly for internally stretching the fabric locally in the area of the creases and an arrangement for applying steam locally to the internally stretched fabric in the area of the creases.

10 Claims, 4 Drawing Sheets

METHOD AND APPARATUS FOR REMOVING CREASES FROM TUBULAR FABRIC

This application is a continuation of application Ser. No. 08/108,339, filed Aug. 18, 1993, now abandoned.

BACKGROUND OF THE INVENTION

The present invention relates broadly to steam treatment of textile fabrics of indeterminate length and, more particularly, to a method and apparatus for steam removal of creases formed in tubular fabric.

Many circular knit fabrics which are produced in tubular form are commonly flattened and wound into rolls for subsequent processing and ultimate shipment to clothing manufacturers for their use. Typically, during the production of tubular fabric, lengthwise creases are formed at diametrically opposed sides in the fabric coming off a knitting machine as the fabric is flattened and rolled. During unwinding and rewinding of the fabric for subsequent processing and finishing, an effort is made to fold the fabric in rewinding along the same creases but, quite often, this objective is not met and new creases are formed alongside the original creases, producing an unsightly appearance to the flattened fabric side edges.

It is known that steam is effective in removing creases from many types of fabrics and a number of apparatus have been proposed for application of steam to an entire piece of tubular fabric as part of the final finishing of such fabrics. However, such apparatus would be unnecessarily wasteful and inefficient to use simply to remove the generally diametrically opposed creases described above.

SUMMARY OF THE INVENTION

It is accordingly an object of the present invention to provide a method and apparatus for effectively removing opposed creases in tubular fabrics. More specifically, it is an object of the present invention to provide a method and apparatus for localized application of steam directly to diametrically opposed, longitudinally extending areas of a tubular fabric to remove such creases in a cost and energy efficient manner.

Briefly summarized, the present invention provides a method and apparatus wherein a tubular fabric is caused to travel longitudinally and, at a predetermined location along the path of fabric travel, the tubular fabric is opened by internally engaging the fabric at the location of the generally diametrically opposed creases in the fabric and holding a localized, lengthwise extent of the fabric in tensioned open-width form, while steam is applied locally to the exterior of the fabric at the location of the generally diametrically opposed creases. At the conclusion of the steam treatment, the fabric may be rolled or wound for shipment to the end user.

The present apparatus includes a drive assembly for causing the fabric to travel longitudinally. The drive assembly is equipped with a plurality of guide rollers, at least one of which is driven, mounted to a frame in spaced-apart opposed facing relation for engagement of the fabric exteriorly to cause the fabric to travel longitudinally. Preferably, the guide rollers are arranged in pairs with at least one guide roller in each pair being driven. Further, the guide rollers may be driven individually at respective predetermined rates allowing the drive rollers to be driven simultaneously at different rotational speeds for localized lengthwise stretching of the fabric for enhanced crease removal.

The present apparatus further includes a fabric tensioning assembly having a pair of wheels spaced apart transversely with respect to the direction of fabric travel to engage the interior of the fabric at the diametrically opposed creases, preferably at the same location as the drive roller assembly. The fabric tensioning arrangement includes a support bar extending intermediate the wheels, the bar preferably including an arrangement for adjusting its length for selectively increasing and decreasing the tension applied interiorly to the fabric.

Steam is preferably applied to the fabric through a steam housing located adjacent the guide rollers, the steam housing having one or more of steam emission openings formed therein for applying steam locally to the fabric in the area of fabric stretching.

DESCRIPTION OF THE PREFERRED EMBODIMENT

Figure 1:
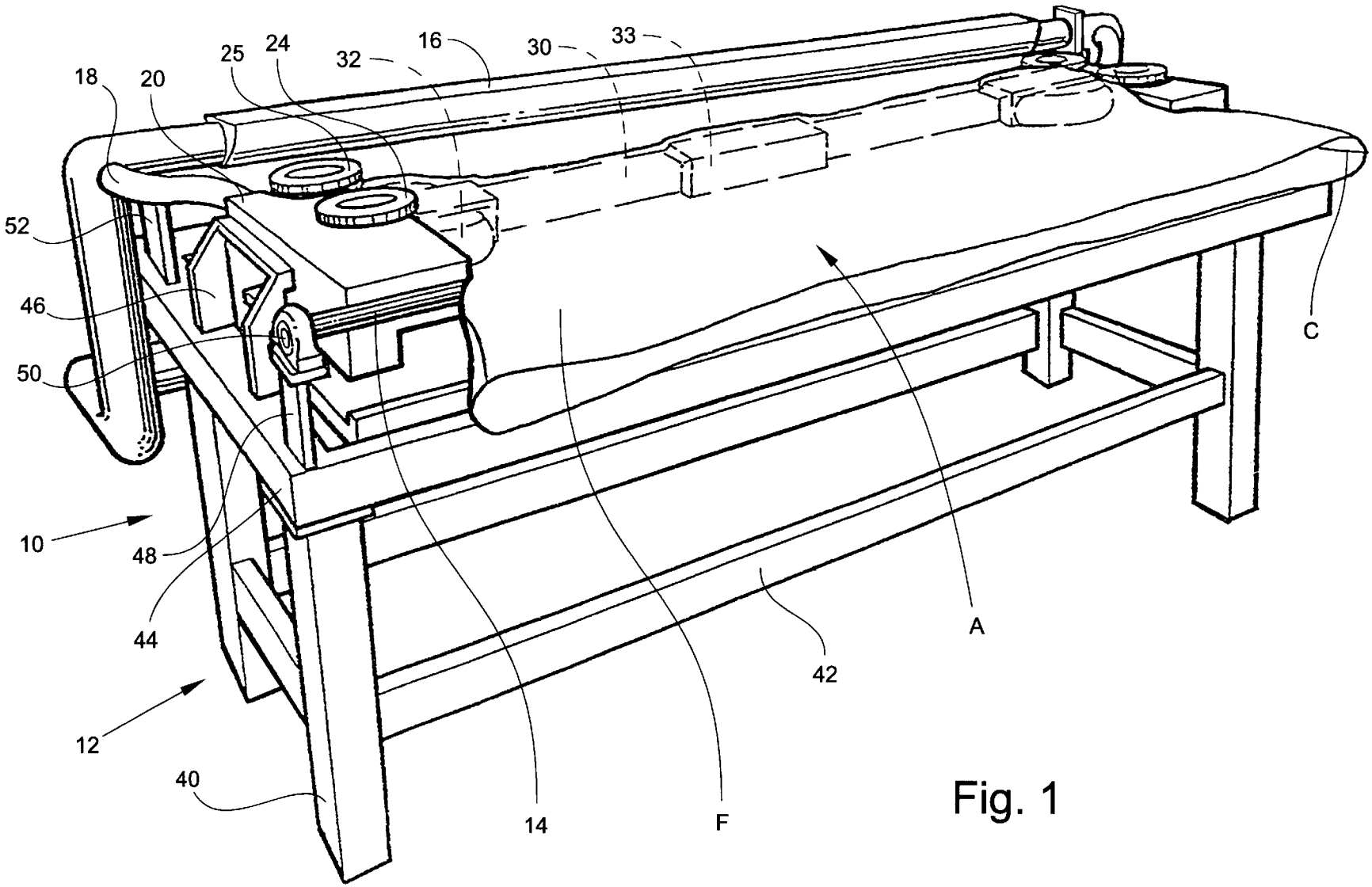
FIG. 1 is a perspective view of an apparatus for removing generally diametrically opposed longitudinally extending creases from a traveling tubular fabric according to the preferred embodiment of the present invention.

Referring now to the accompanying drawings and initially to FIG. 1, an apparatus for removing generally diametrically opposed longitudinally extending creases from a tubular fabric according to the preferred embodiment of the present invention is indicated generally at 10 and includes a rectangular floor-standing frame 12 having a relatively wide lateral extent to accommodate travel thereover of a tubular textile fabric in an open-width generally flattened condition. The frame 12 includes four upright frame members 40 defining the corners of the frame 12. The upstanding frame members 40 are reinforced by laterally extending lower cross braces 42 adjacent the midpoint of the upstanding frame members 40 and extending therebetween and laterally extending upper cross braces 44 fixed to the uppermost portions of the upstanding frame members 40. The upper cross braces 44 define the upper surface of the frame 12 and provide a platform for supporting the operational apparatus of the present invention and further define a fabric travel path A traversing the lateral extent of the frame 12.

A generally elongate tubular steam header 16 is connected to a steam generator or other suitable source of steam (not shown) and is mounted to the upper surface of the frame 12 to extend generally the full lateral extent of the frame 12, transversely to the direction of fabric movement. The steam header 16 is supported in a spaced relation above the upper surface of the frame 12 by upstanding brackets 52 which project upwardly from the upper frame members 44 adjacent two corners of the frame 12. Hoses 18 provide communication between the steam header 16 and two steam boxes 20, which will be explained in greater detail hereinafter.

A fabric guide member 14 is provided to support and provide directional control for fabric entering the fabric travel path A. The fabric guide member 14 is a smooth, cylindrical bar which extends laterally across the frame 12, transversely with respect to the fabric travel path A, and is supported in a raised disposition from the upper frame members 44 by upstanding brackets 48 located on the upper frame members 44 at the corners opposite those to which the steam header brackets 52 are mounted. The fabric support member 14 is supported by journal bearings 50 which are mounted to the upper portions of the fabric support member brackets 48, allowing the fabric support member 14 to rotate, thereby providing smooth fabric movement.

Two pairs of guide rollers 24,25 are provided for driving movement of the fabric along the fabric travel path A, each pair being located at opposite lateral sides of the frame 12 intermediate the steam header 16 and the fabric guide member 14, with the roller pairs in generally facing spaced-apart opposition to one another. The guide rollers 24,25 are formed as upstanding spools having smoothly curved concave side walls 26 with the rollers 24,25 of each pair being mounted in adjacent spaced relation, each of the rollers 24 being driven in common and each of the rollers 25 similarly being driven in common independently of the rollers 24 for advancing the fabric F along the fabric travel path A.

Figure 2:
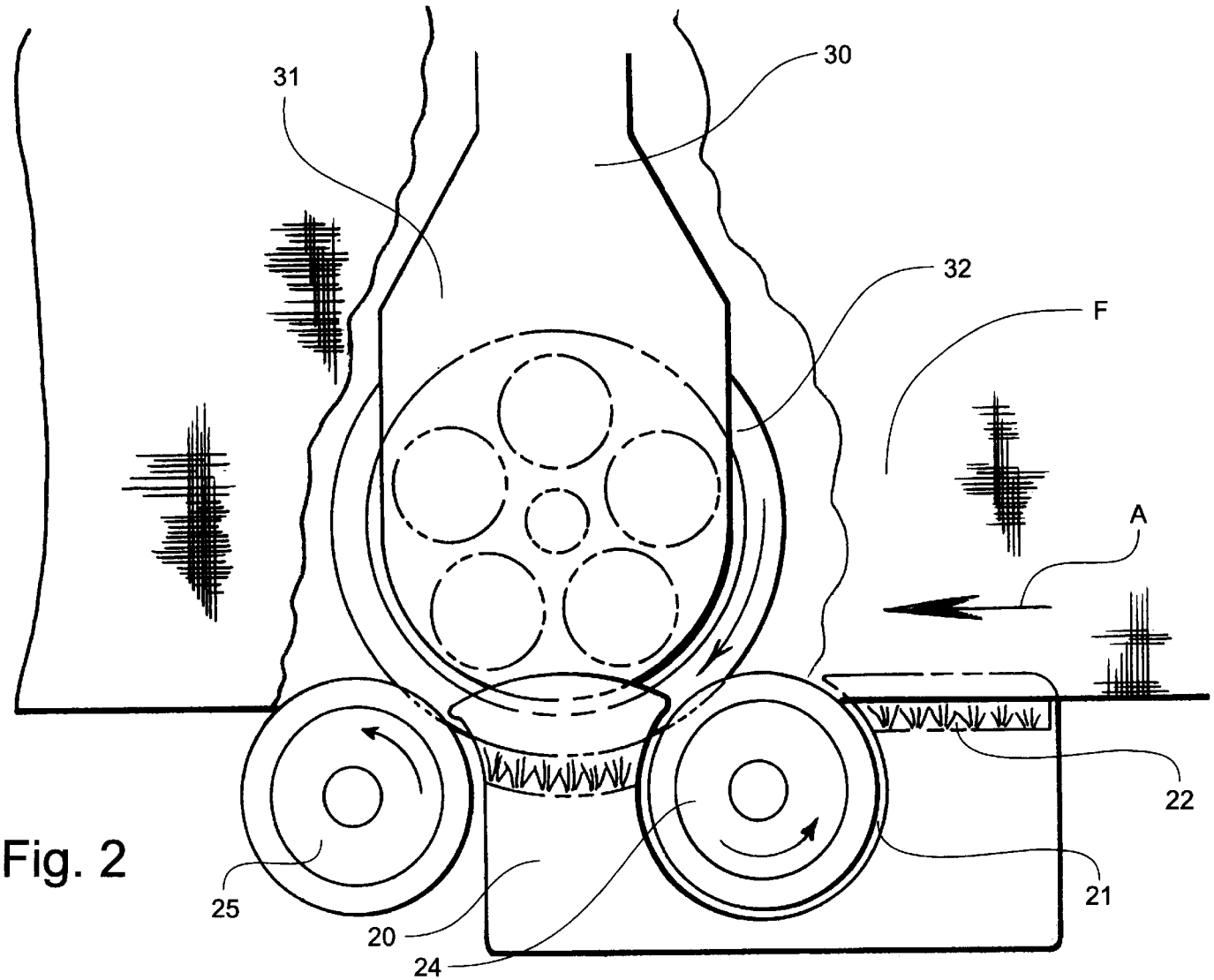
FIG. 2 is a top plan view of the fabric treatment area of the apparatus of FIG. 1 with the fabric partially broken open to reveal the fabric tensioning arrangement.

Two steam boxes 20 are provided for localized application of steam to the fabric F and are likewise located in spaced opposition to each other across the widthwise extent of the frame 12. Each steam box 20 is of a generally rectangular configuration with a generally circular recess 21 formed in one side thereof configured to accommodate the respective adjacent guide roller 24 so that a portion of the steam box 20 extends intermediate the respective pair of guide rollers 24,25, all as best seen in FIG. 2. Each steam box 20 has a plurality of steam emission openings 22 facing inwardly toward the center of the frame 12 through which steam is applied locally to the fabric F. The emission openings 22 of each box are positioned on each side of its recess 21 so that steam is applied to the fabric prior to contact with the first guide rollers 24 (in the direction of fabric travel) and intermediate the guide rollers 24,25 of each roller pair.

The guide roller pairs 24,25 and the steam boxes 20 are each mounted to a generally rectangular support member 60 having a support bearing 36 mounted to either side thereof. The support bearings 36 are generally rectangular members, each having a passageway formed lengthwise therethrough. Two mounting rods 38 extend the full widthwise extent of the frame 12 and each passes through one of the passageways formed in the support bearings 36 so that the support member 60 is slidably mounted intermediate the two mounting rods 38. The end portions of the mounting rods 38 are each supported by a generally cubical rod mounting block 62 positioned at each terminal end of each mounting rod 38. The rod mounting blocks 62 are fixed on frame support rails 64 which extend across the entire widthwise extent of the frame 12.

Figure 4:
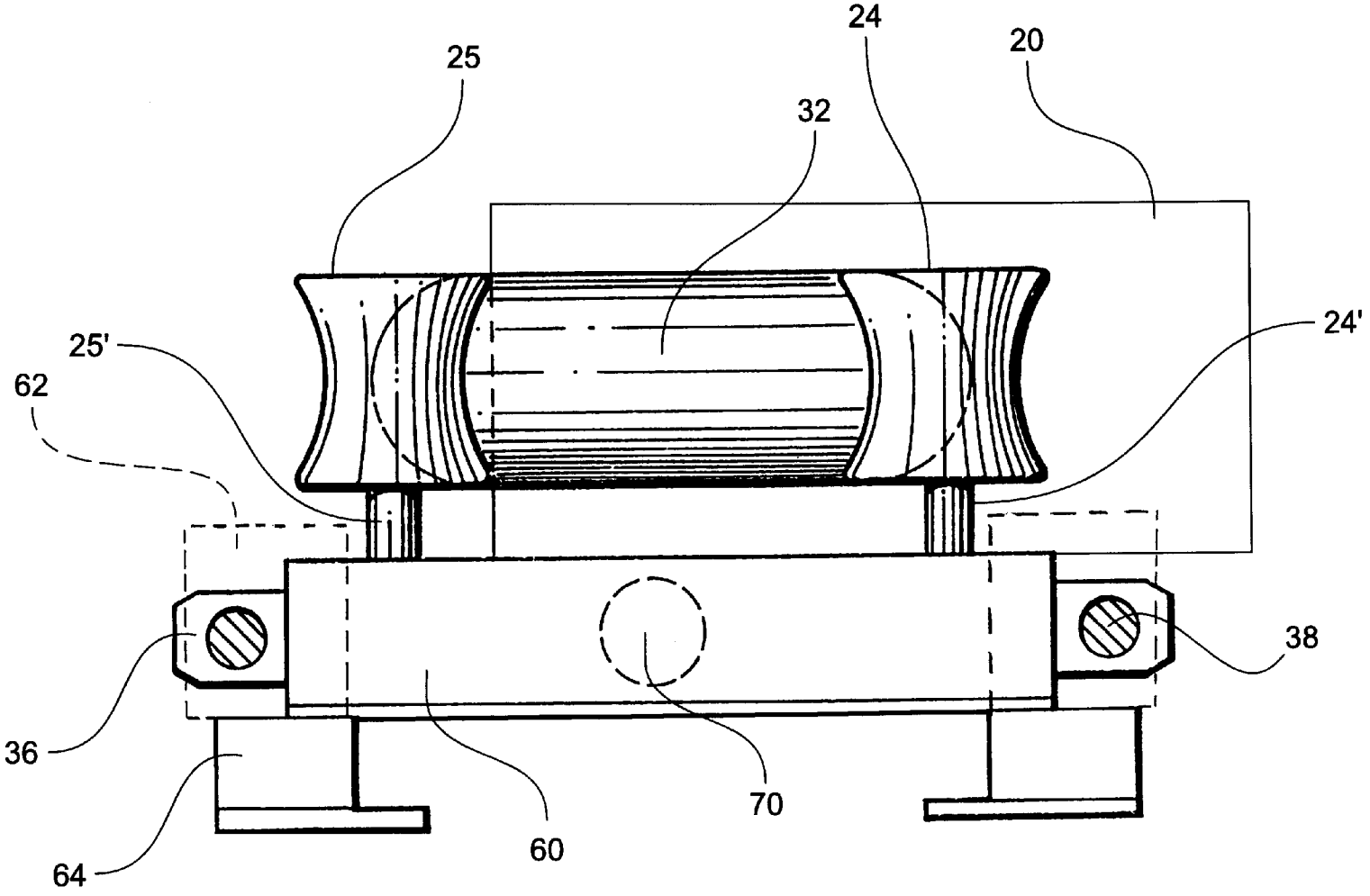
FIG. 4 is a partial side view of the apparatus of FIGS. 1 and 2.

A conventional ball screw 70, which is represented schematically in FIG. 4, is centrally threaded through each support member 60 with one end of the screw 70 connected to a drive motor (not shown) to drive movement of the support members 60 toward and away from one another slidably along the mounting rods 38. In this manner, the support members 60 with their associated guide rollers 24,25 and steam boxes 20 may be moved in synchronism inwardly toward the center of the frame 12 or outwardly away from the center of the frame 12, as will be explained in greater detail hereinafter. Drive motors (not shown) are mounted to the support members 60 to provide driving movement to the guide rollers 24,25 through associated spindles 24',25'.

Figure 3:
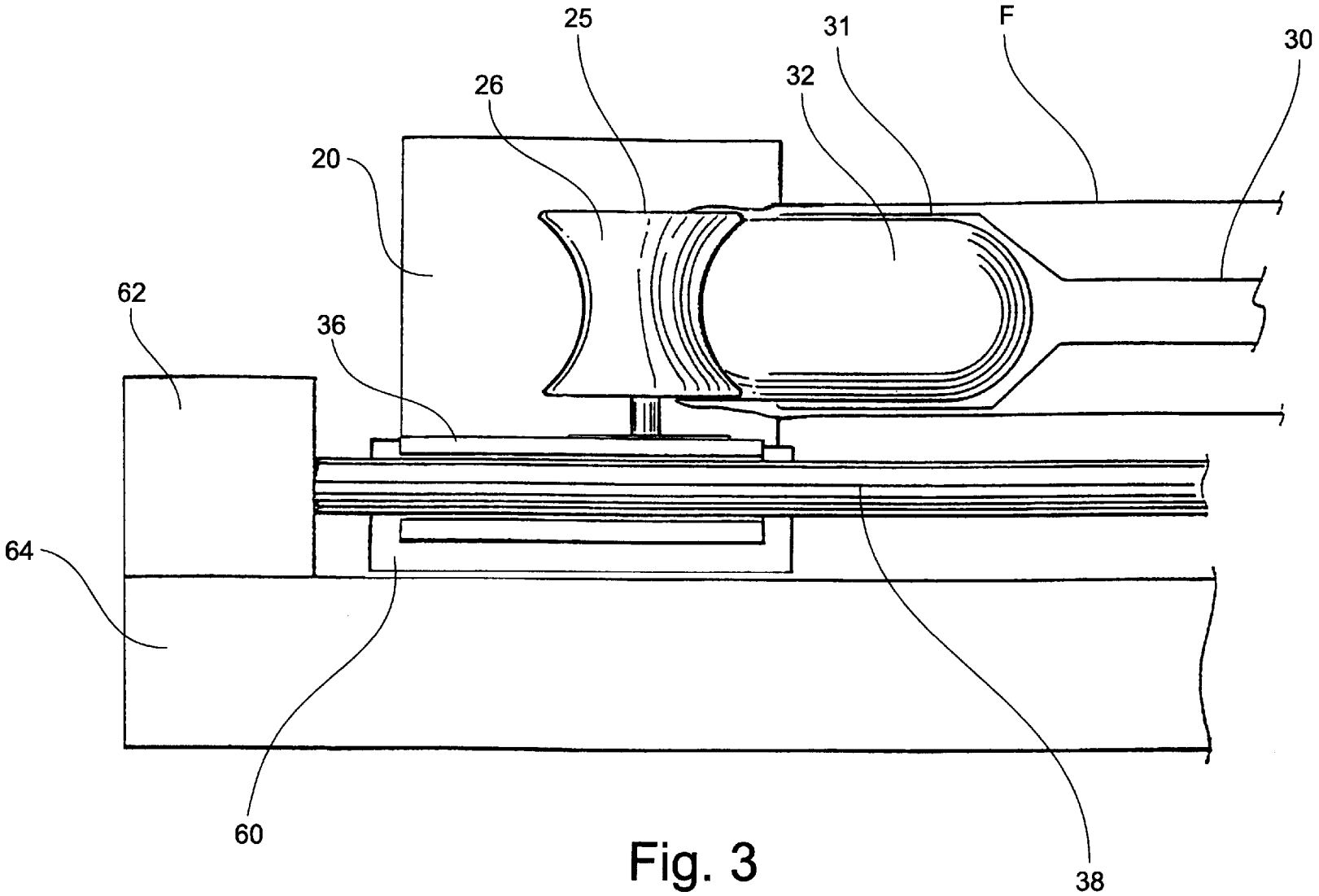
FIG. 3 is a front elevational view of the fabric treatment area of the apparatus of FIGS. 1 and 2.

In order to effectively present the opposed creases in tubular fabric to the steam boxes 20, the fabric F is internally stretched by a stretcher bar assembly 30 which is a generally elongate member separate from the primary frame structure of the present invention and configured to extend from one steam box 20 to another across the lateral extent of the fabric travel path A. Referring now to FIG. 3, the stretcher bar 30 includes a generally Y-shaped yoke 31 at each end thereof. A wheel 32 is fitted within the recess formed by each yoke 31 for internal fabric engagement, the outer surface of the wheel 32 being formed with a convex curvature configured to mate with the concave side walls 26 of the guide rollers 24,25. As best seen in FIG. 1, the stretcher bar 30 includes a length adjustment assembly 33 located generally in the mid-section thereof providing selective internal tensioning and stretching of the fabric F.

In operation, according to the method of the present invention, and with reference to FIG. 1, a tubular length of fabric F having creases C formed therein in generally diametric opposition to one another is fed to the apparatus 10 over the guide member 44 with the creases disposed at the opposite lateral sides of the apparatus 10. The stretcher bar 30 is inserted within the fabric tube with its wheels 32 disposed at the opposed creases C and the stretcher bar 30 with the associated fabric is placed intermediate the opposed guide roller assemblies and extended until the fabric is sufficiently stretched to hold the creased areas taut over the wheels 32. The ball screw 70 is driven to move the support members 60 toward one another until the curvature of each wheel 32 is securely received and seated between the respective guide roller pairs 24,25 within the curvature of the side walls 26 of each pair of the guide rollers 24,25, giving the wheels 32 the capability of rotating with both guide rollers 24,25 of each pair for driving lengthwise movement of the fabric F. The degree of extension of the stretcher bar 30 using the adjustment assembly 33 together with the spacing of the guide roller pairs 24,25 should be sufficient to hold the fabric F in a taut stretched condition intermediate the stretcher bar wheels 32 and the guide rollers 24,25.

Steam is supplied through the steam header 16 to the steam boxes 20 for direct localized application to the opposite sides of the fabric F as seen in FIG. 2. While the steam is being applied, the drive rollers 24 are driven which in turn rotates the wheel 32 attached to the stretcher bar 30 providing smooth fabric movement along the fabric travel path A. The rotational directions of the guide rollers 24,25 and the wheel 32 are indicated by arrows in FIG. 2. Linear fabric travel is also indicated by arrow A in FIG. 2. As previously mentioned, the guide rollers 24,25 may be selectively driven individually at differing speeds if desired to additionally stretch the fabric longitudinally with respect to the crease C for enhanced crease removal.

As the fabric F is transported along the fabric travel path A, steam is applied locally to each crease C prior to its initial contact with the guide rollers 24,25 as a preparatory steaming. The fabric then passes intermediate the initial guide rollers 24 and the wheels 32, thus stretching and thereby flattening the creases C. Steam is then reapplied to the creases C intermediate the guide rollers 24,25 with the fabric F fully stretched internally by the stretcher bar 30 and its wheels 32. The fabric F is then passed between the wheels 32 and the final guide roller 25 where additional flattening occurs. The combination of stretching, flattening and localized steam application effectively removes the crease C. As mentioned, should additional stretching be necessary or desirable for effective crease removal, the rotational speed of either guide roller 24,25 in a pair may be selectively increased or decreased to stretch the fabric longitudinally. After the length of fabric F passes through the fabric treatment area A, it may be removed and packaged for shipment or dispatched elsewhere for use.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for removing generally diametrically opposed longitudinally extending creases from a tubular fabric comprising:

(1) means for causing the fabric to travel in a longitudinal path with the creases extending longitudinally along side portions of the tubular fabric;

(2) fabric tensioning means for opening the tubular fabric at a predetermined location along the path of fabric travel by internally engaging the fabric at the location of the generally diametrically opposed creases in the fabric and holding a localized lengthwise extent of the fabric in tensioned open-width form; and (3) means for directing and applying steam localized to essentially only the side portions of the fabric while traveling across said tensioning means, said steam directing and applying means directing steam from laterally outwardly of the side portions of the fabric in a direction laterally inwardly across a fabric plane and transverse to fabric movement thereby directing steam essentially only locally to the exterior of the fabric at the location of the generally diametrically opposed creases.

2. An apparatus for removing generally diametrically opposed longitudinally extending creases from a tubular fabric according to claim 1 wherein said means for causing the fabric to travel longitudinally includes a plurality of guide rollers, at least one of said guide rollers being driven, mounted to a frame in spaced-apart opposed facing relation for engagement of the fabric exteriorly to cause the fabric to travel longitudinally.

3. An apparatus for removing generally diametrically opposed longitudinally extending creases from a tubular fabric according to claim 2 wherein said guide rollers are arranged in pairs, at least one guide roller in each pair being driven.

4. An apparatus for removing generally diametrically opposed longitudinally extending creases from a tubular fabric according to claim 3 wherein said driven guide rollers may be individually driven at various predetermined rates allowing said driven rollers to be selectively driven simultaneously at different rotational speeds for localized lengthwise stretching of the fabric for enhanced crease removal.

5. An apparatus for removing generally diametrically opposed longitudinally extending creases from a tubular fabric according to claim 1 wherein said fabric tensioning means includes a pair of wheels spaced transversely with respect to the direction of fabric travel for engaging the interior of said fabric at said diametrically opposed creases.

6. An apparatus for removing generally diametrically opposed longitudinally extending creases from a tubular fabric according to claim 5 wherein said fabric tensioning means includes a bar extending intermediate said wheels, said bar including means for adjusting the length of said bar for selectively increasing and decreasing the tension applied interiorly to the fabric.

7. An apparatus for removing generally diametrically opposed longitudinally extending creases from a tubular fabric according to claim 1 wherein said steam applying means includes a steam housing adjacent said guide rollers, said steam housing having a steam emission opening formed therein for applying steam locally to the fabric in the area of fabric stretching.

8. A method for removing generally diametrically opposed, longitudinally extending creases from a tubular fabric comprising the steps of:

(1) causing the tubular fabric to travel in a longitudinal path;

(2) opening the tubular fabric at a predetermined location along the path of fabric travel by internally engaging the fabric at the location of the generally diametrically opposed creases in the fabric; and (3) during said opening, directing and applying steam locally to the exterior of the fabric essentially only at the location of the generally diametrically opposed creases.

9. An apparatus for removing generally diametrically opposed longitudinally extending creases from a tubular fabric comprising:

(1) means for causing the fabric to travel in a longitudinal path including at least two guide rollers mounted to a frame in generally longitudinal alignment along the fabric travel path with a spacing therebetween, said spacing defining a zone therebetween;

(2) fabric tensioning means for opening the tubular fabric at a predetermined location along the fabric travel path including means for internally engaging the fabric at the location of the generally diametrically opposed creases, said engaging means including at least one wheel for engaging said guide rollers to direct the creases through said zone; and (3) means for applying steam to the fabric including a housing mounted to said frame with at least one portion of said housing extending intermediate said guide rollers, said at least one portion including a steam application nozzle configured to apply steam directly to the fabric creases as said fabric transits said zone.

10. An apparatus for removing generally diametrically opposed longitudinally extending creases from a tubular fabric comprising:

(1) means for causing the fabric to travel in a longitudinal path;

(2) fabric tensioning means for opening the tubular fabric at a predetermined location along the path of fabric travel by internally engaging the fabric at the location of the generally diametrically opposed creases in the fabric and holding a localized lengthwise extent of the fabric in tensioned open-width form; and (3) means for applying steam localized to essentially only the generally diametrically opposed creases of the fabric while traveling across said tensioning means.

* * * * *